United States Patent [19]

Yeager

[11] Patent Number: 4,947,663

[45] Date of Patent: Aug. 14, 1990

[54] SECURITY DEVICE FOR DEAD BOLT DOOR LOCK

[76] Inventor: Elmer R. Yeager, 7892 Sailboat Key Blvd., Unit 602, South Pasadena, Fla. 33707

[21] Appl. No.: 490,311

[22] Filed: Mar. 8, 1990

[51] Int. Cl.[5] ..... E05B 63/00

[52] U.S. Cl. ..... 70/416; 70/419

[58] Field of Search ..... 70/416, 419, 429, 430, 70/447, DIG. 50

[56] References Cited

U.S. PATENT DOCUMENTS

| | | | |
|---|---|---|---|
| 3,423,974 | 1/1969 | Bernsler | 70/416 |
| 3,748,882 | 7/1973 | DuSault | 70/416 |
| 3,921,423 | 11/1975 | Hollins | 70/416 |

*Primary Examiner*—Robert L. Wolfe

*Attorney, Agent, or Firm*—Walter J. Monacelli

[57] ABSTRACT

The lock security device described herein is designed to prevent the turning of the lock from the opposite side of the lock, for example, by the turning of a key from the outside or opposite side of the lock. With most dead bolt door locks there is a knob on the inner side of the door by which the bolt of the lock may be moved forward into a locking position or retracted into an unlocking position. These same actions may be performed by a key inserted into the lock from the outside of the door. The security device is a simple knob on the inner side of the door with a flap which may be turned to press against the inside knob which controls the position of the bolt of the lock. When the bolt is in locked position, this flap is turned toward the bolt controlling knob and engages it to prevent turning of the same into an unlocking position. This flap is prevented from slipping to or from this engaging position by a spring on the inside of the flap knob which exerts pressure against the turning of this flap.

6 Claims, 1 Drawing Sheet

SECURITY DEVICE FOR DEAD BOLT DOOR LOCK

BACKGROUND OF THE INVENTION

1. Field of the Invention

This invention relates to a simple security device for preventing a door from being opened by the insertion of a key from outside the door. More specifically, this invention relates to a pivotal flap which may be turned to prevent movement of the inside latch knob which controls movement of the dead bolt of the door. Still more specifically, this invention relates to a pivotal flap device which has a spring in the interior thereof which retards accidental turning of the flap to an unsecured position. Still more specifically, this invention relates to a security device which guards against unlocking of a door from the outside by a very simple pivotal flap which is spring guarded against accidental slipping into guarding position. Still more specifically, this invention relates to a security device which is easily and simply attached to existing door locks.

2. State of the Prior Art

There are a number of patents describing various devices for securing door locks from being opened from the outside and from accidental release from such security. These include U.S. Pat. Nos. 192,443; 1,048,784; 3,423,974; 3,748,882; 3,921,423; 4,055,361; 4,152,911; 4,185,483 and 4,279,137. The first three of these patents relate to doors having door knobs on the outside as well as on the inside instead of relying on the insertion of a key from the outside. Moreover these are not dead bolt locks as involved in the present application.

Pat. No. 3,748,882 pertains to a securing device designed for a door lock having a non-circular knob on the inside and describes a complicated securing device for embracing the whole one side of the knob and preventing its turning.

Pat. No. 3,921,423 describes a complicated device for attachment to a dead bolt lock for preventing the turning of the dead bolt control knob. This involves a long sliding bolt and a bracket for holding the sliding bolt therein in and out of contact with the latch knob.

Pat. No. 4,055,361 is a thumb knob assembly that may be substituted for the original thumb knob assembly that comes with the original dead bolt lock. Although this assembly prevents the opening of the lock by a key from the outside, it involves the substantial replacement of the lock assembly.

Pat. No. 4,152,911 discloses an elongated flanged member which is pivotal to an interference and non-interference positions with the bolt moving knob. This is a complicated four-flanged device to embrace the bolt drawing knob for preventing rotation of the same.

Pat. No. 4,185,483 describes the use of six-sided wedge between the door knob handle and the latch which controls the movement of the dead bolt.

Pat. No. 4,279,137 discloses a sliding double bolt device which embraces the latch bolt from both sides and prevents rotation of the same. This represents a complicated structure which needs to be assembled on the door.

None of these patents show the simple device of this invention which may be added to installed door locks by drilling only one hole in the door for a very simple attachment, and the device is very simply designed to avoid accidental locking of the latch knob.

OBJECTIVES

It is an object of this invention to provide a very simple device to prevent outside opening of a dead bolt door lock.

It is also an object of this invention to provide such a device which can be easily installed on an already installed dead bolt lock.

It is also an object of this invention to provide a device which does not have any tendency to accidently lock the dead bolt latch.

Other objects will become obvious upon reading the detailed description of the invention as given hereinafter.

SUMMARY OF THE INVENTION

In accordance with the present invention these objectives are met by the device described herein which comprises a pivotal flap movable to a locking engagement with the latch knob of a dead bolt lock. This pivotal flap is secured to the door in an appropriate position by means of one hole in the door surface into which a bolt is threaded. This bolt is the pivoting means for the flap and comprises an unthreaded portion and a threaded portion. The unthreaded portion is designed to provide a limit to the tightening of the bolt onto the door. A coil spring is wrapped around the bolt and the tightening of the bolt effects a tightening effect on the spring which enables the flap to stay in whatever position to which it is moved manually.

The description of the device of this invention is facilitated by reference to the accompanying drawings.

Figure 1:
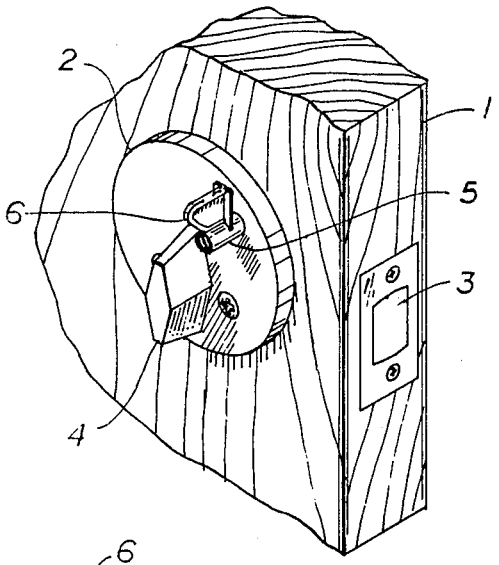
FIG. 1 is a perspective of a door to which a lock and the lock security device of this invention has been added.

More specifically, in FIG. 1 a section of a door 1 is shown in which lock 2 has been installed. Bolt 3 is shown in retracted position and bolt knob 4 is shown in a vertical position which means that the dead bolt 3 is withdrawn. Security device 5 is shown in non-securing position.

Figure 2:
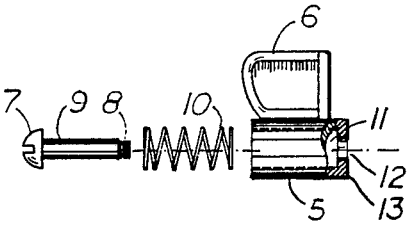
FIG. 2 is an exploded view of the various parts of the lock security device.

FIG. 2 shows the security device 5 with pivotal flap 6 in raised position. Bolt 7 with a limited threaded section 8 and unthreaded section 9. Spring 10 fits around unthreaded portion 9 of bolt 7 and into opening 11 which extends most of the way through security device 5. Opening 12 extends through end wall 13 and the remainder of the distance through security device 5 so that the unthreaded portion 9 of bolt 7 can be passed therethrough and come in contact with lock 2 when thread portion 8 is screwed into an appropriate threaded opening (not shown) in lock 2. When bolt 7 is tightened against spring 10, the pressure exerted by spring 10 against end wall 13 decreases any tendency for security device 5 and flap 6 to rotate.

Figure 3:
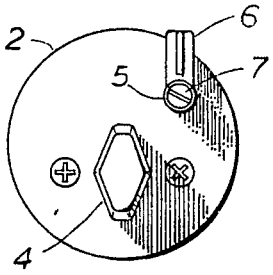
FIG. 3 is a front elevational view of the lock with the bolt knob in retracted position and the security device in non-contact position.
Figure 4:
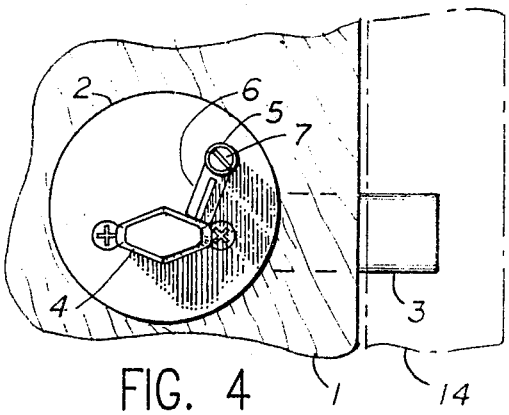
FIG. 4 is a front elevational view of the lock with the bolt knob in locked position with the security device in contact position to prevent turning of the knob.

In FIG. 3 the flap 6 of the security device is turned away from knob 4 whereas in FIG. 4, the knob 4 is turned horizontal to thrust bolt 3 outward to extend into frame 14 (shown in phantom) and flap 6 is turned into locking position against knob 4. The spring inside the security device keeps the security device tightly in position. The length of the spring coil is long enough to give the desired amount of pressure of wall 13 against the surface of the lock in which the threaded opening for bolt 7 is positioned.

As previously stated, one of the chief advantages of this security device is the simplicity of the device and the simplicity of its operation. In the event it is found that there is not sufficient pressure exerted by wall 13 against the surface of the lock, the pressure may be increased by substituting another spring coil having a greater length so that under the tightening of bolt greater compressive force will be exerted on the spring and therefore greater pressure of wall 13 against the lock surface.

Another advantage is the simplicity of installation. This is effected by positioning latch or knob 4 in the position shown in FIG. 4 whereby the bolt 3 is in its forward or locking position. Then a line is drawn or marked off substantially perpendicular to the surface of the latch 4 and a distance marked on this line reaching to the point which will coincide with the center of bolt 7 when it is installed. A hole is drilled at this center point and threaded to receive the bolt threads. It may be suitable in some cases to omit the threads in the drilled opening and to use a self threading bolt for bolt 7. Moreover while the contact surface on latch 4 is shown as flat, it is also contemplated that this surface may also be concave or convex in which case the line from the point of contact to the center of the bolt will be perpendicular to the tangent drawn at the point of contact.

The invention described herein may be summarized as a door and lock assembly comprising a door having opposite sides, a frame defining an opening adapted to be closed by this door, and a bolt in this door to be displaced into the frame to lock the door thereto, a pivotable control knob on one side of the door coupled to the bolt to control displacement of the bolt, this knob being pivotable between limits at first and second positions, this bolt being displaced into the frame in accordance with the first position of the knob and out of the frame in accordance with the second position, and means pivotable into and out of a position of interference with respect to the pivoting of this knob and adapted, when in a position of interference, to brace the knob in the first position to lock the bolt in the frame, this means including a pivot defining a pivot axis, this knob including a contact surface, preferably a flat surface, for engagement with this means, this means including a rigid structure pivotable on its axis to a position between this axis and the contact surface, this rigid structure having a length substantially corresponding to the distance between the axis and the contact surface with the knob in the first position, this means being on the same side of the door as the knob and spaced from the other side of the door.

This pivotal means for interference with the knob comprises a flap having a length from the pivotal axis therein sufficient to reach the point of interference contact on the contact surface of the control knob. When the contact surface on the knob is a flat surface, a line from the pivot axis to the point of interference contact makes substantially a 90° angle with the flat contact surface. This flap also has an opening extending through the flap with the axis of the opening being perpendicular to the longitudinal axis of the flap, with the end of the opening being narrower in diameter than the diameter of the major part of the opening.

The pivotal interference means also comprises a threaded bolt adapted to fit into an opening in the lock surface appropriately positioned to have the longitudinal axis coincide with or comprise the pivotal axis of the flap, with the center of the opening positioned and the pivotal axis of the flap positioned to give the appropriate distance between the pivotal axis and the point of interference contact.

The pivotal interference means also comprises a coil spring adapted to surround a portion of the threaded bolt and also to fit into the opening in the flap with one end of the coil spring pressing against the flap at the narrower end of this opening, so that when the threaded bolt is fitted into the opening in the lock surface and tightened against the coil spring so as to compress the spring, this will exert pressure of the flap against the lock surface so as to create friction therebetween.

The opening into the lock surface into which the threaded bolt is fitted may be threaded so as to receive the threads on the bolt or it may be unthreaded in which case the threaded bolt may be self-threading. The head of the bolt is advantageously small enough to fit into the larger part of the opening but not small enough to pass through the smaller part of the opening. However if the head of the bolt is larger than the opening, then a longer coil spring may be used to give the desired amount of compression in the spring.

While certain features of this invention have been described in detail with respect to various embodiments thereof, it will of course be apparent that other modifications can be made within the spirit and scope of this invention, and it is not intended to limit the invention to the exact details insofar as they are defined in the following claims.

The invention claimed is:

1. In a door and lock assembly comprising a door having opposite sides, a frame defining an opening adapted to be closed by said door, and a bolt in said door to be displaced into said frame to lock said door thereto, a pivotable control knob on said door on one side of the same and coupled to said bolt to control displacement of the same, said knob being pivotable between limits at first and second positions, said bolt being displaced into said frame in correspondence with the first position of the knob and out of said frame in correspondence with said second position, and means pivotable into and out of a position of interference with respect to the pivoting of said knob and adapted, when in a position of interference, to brace said knob in said first position to lock said bolt in said frame, said means including a pivot defining a pivot axis, said knob including a contact surface for engagement with said means, said means including a rigid structure pivotable on said axis to a position between said axis and said contact surface, said structure having a length substantially corresponding to the distance between said axis and said contact surface with said knob in said first position, said means being on the same side of the door as said knob and spaced in entirety from the other side of the door, the improvement in which said interfering pivotal means comprises:

(a) a flap having a length sufficient from said pivot axis therein to reach the point of interference contact with said contact surface of said control knob in said first position, a line from said pivot axis to said point of interference contact making substantially a 90° angle with said contact surface, said flap also having an opening extending through said flap, the axis of said opening being perpendicular to the longitudinal axis of said flap;

(b) a threaded bolt having a head of greater diameter than the remainder of the bolt, said bolt being adapted to fit through said flap opening and to serve as the pivoting means for said flap;

(c) an opening in the surface of said lock assembly whose center coincides with the pivotal point of said flap and adapted to receive the threads of said threaded bolt; and (d) a coiled spring adapted to surround a portion of the said threaded bolt, to fit into the opening in said flap and when compressed within the opening in said flap to press a portion of said flap against the surface of said lock assembly in which said lock assembly opening is located, whereby friction is created between said flap and said lock assembly surface.

2. The door and lock assembly of claim 1 in which the opening in said flap has a larger diameter in one portion where the coil is to be positioned and a smaller diameter in another portion of this opening which is to be adjacent to said surface of said lock assembly in which said lock assembly opening is positioned, whereby in said flap opening the smaller diameter portion will allow passage of said threaded bolt but will not allow passage of said coil spring and whereby when said coil spring is retained in compressed condition by said threaded bolt in said lock assembly opening, the spring will exert a pressure on said flap against said lock assembly surface.

3. The door and lock assembly of claim 2 in which the opening in said lock assembly surface has threads adapted to receive the threads on said threaded bolt.

4. The door and lock assembly of claim 1 in which the opening in said lock assembly surface has threads adapted to receive the threads on said threaded bolt.

5. The door and lock assembly of claim 3 in which said bolt head is small enough to fit into the flap opening portion of larger diameter and large enough to not fit into the interior of said coil spring.

6. The door and lock assembly of claim 5 in which said threaded bolt has threads a limited portion from the end thereof and the remainder of the bolt to said head is unthreaded.

* * * * *